US006248402B1

(12) United States Patent
Guyonnet et al.

(10) Patent No.: US 6,248,402 B1
(45) Date of Patent: Jun. 19, 2001

(54) METHOD FOR TREATING WOOD BY IMPREGNATION

(75) Inventors: René Guyonnet, Saint-Etienne; Pierre Gohar, Nouaille Maupertuis, both of (FR)

(73) Assignee: NOW - New Option Wood, Saintes (FR)

( * ) Notice: Subject to any disclaimer, the term of this patent is extended or adjusted under 35 U.S.C. 154(b) by 0 days.

(21) Appl. No.: 09/297,277

(22) PCT Filed: Oct. 28, 1997

(86) PCT No.: PCT/FR97/01933

§ 371 Date: Apr. 28, 1999

§ 102(e) Date: Apr. 28, 1999

(87) PCT Pub. No.: WO98/18606

PCT Pub. Date: May 7, 1998

(Under 37 CFR 1.47)

(30) Foreign Application Priority Data

Oct. 29, 1996 (FR) ..... 96 13168

(51) Int. Cl.[7] ..... B05D 3/02; B05D 3/12
(52) U.S. Cl. ..... 427/297; 427/382; 427/393
(58) Field of Search ..... 427/297, 379, 427/382, 393

(56) References Cited

U.S. PATENT DOCUMENTS 3,553,005 * 1/1971 Moragne .
3,765,934 * 10/1973 Gaylord .

FOREIGN PATENT DOCUMENTS

626240 * 11/1994 (EP) .
1 406 137 11/1965 (FR) .
2 604 942 4/1988 (FR) .
2 720 969 12/1995 (FR) .
1178215 * 1/1970 (GB) .
1249581 * 10/1971 (GB) .
48-056806 * 8/1973 (JP) .
WO 86/00041 1/1986 (WO) .
9303896 * 3/1993 (WO) .
WO 94/29102 12/1994 (WO) .

OTHER PUBLICATIONS

Tsai et al, Kuo Li Tai–Wan, No. 82, 1970.*
Narayanamurti, Holztechnologie, 13(2), pp 118–21, 1972.*
translation of JP48–056806, Aug. 1973.*
translation of Tsai, Kuo Li, 1970, No. 82, pp 2–13.*

* cited by examiner

*Primary Examiner*—Erma Cameron
(74) *Attorney, Agent, or Firm*—Young & Thompson

(57) ABSTRACT

A method for treating wood in which the wood to be treated is placed in a chamber in which a vacuum is produced, where the chamber is filled with a hardening product, in particular a monomer, so as to impregnate the wood by causing the product to penetrate the space between its fibers, where the product is hardened, in particular by polymerization. This method is characterized in that the wood impregnating operation is preceded by a step of controlled thermal treatment.

7 Claims, 1 Drawing Sheet

METHOD FOR TREATING WOOD BY IMPREGNATION

CROSS REFERENCE TO RELATED APPLICATION

This is the 35 USC 371 national stage of International application PCT/FR97/01933 filed on Oct. 28, 1997 which designated the United States of America.

FIELD OF THE INVENTION

The present invention relates to an improvement in methods for treating wood in which the latter is impregnated with a hardening product.

BACKGROUND OF THE INVENTION

It is known that, in the natural state, wood or wood fibers which are in contact with a humid atmosphere tend to be water-logged, going as far as absorbing 100% of their weight with water. Such absorption of water is accompanied by a swelling, characteristic of a reduction in the qualities of cohesion of the material which, in certain cases, may go as far as an advanced disintegration of said material. This is why it is usual to effect, before any wood-fashioning operation, a step of drying which, by eliminating the water therefrom, improves its dimensional stability.

Although the step of drying makes it possible to eliminate the water from the wood, it does not, on the contrary, modify the hydrophilic nature thereof, so that it is again capable of reabsorbing the water eliminated during drying, when it is again located in a humid atmosphere.

In order to reduce the hydrophilic nature of natural wood, and thus to give it a long-lasting dimensional stability, different high-temperature heat-treatment techniques have been proposed.

Among these techniques, it has been proposed to subject the natural wood to different steps of treatment including in particular a drying in open circuit followed by heating and maintaining at a temperature included between about 220° C. and 300° C. for a determined period. Such a technique of treatment, called controlled thermal treatment (curing), makes it possible to give the wood both a hydrophobic nature and an excellent dimensional stability.

It has also been proposed, particularly in order to improve the mechanical properties of the wood, to call upon techniques of treatment which consist in impregnating the wood with a monomer then, such impregnation having been effected, in polymerizing it in situ, employing different techniques to that end, such as in particular the action of a gamma radiation or the action of heat.

The methods of treatment used in the prior state of the art consist in disposing the wood to be treated in a chamber in which a vacuum is created, in filling said chamber with the impregnating monomer, and in applying a high pressure in this chamber so as to cause the monomer to penetrate in the wood. All that remains is to polymerize the monomer.

Although these techniques prove to be satisfactory from the standpoint of improving the mechanical properties of the treated wood, and particularly from that of the hardness, they are much less so from that of the stability by volume of the wood in a humid atmosphere. It has thus been noted that the woods thus impregnated presented the particularity, after a certain time of use, of losing their adherence with the polymer with which they were impregnated, which was translated by this wood swelling.

SUMMARY OF THE INVENTION

The present invention has for an object to propose an improvement in techniques of impregnating woods with hardening products, and particularly by monomers, with a view in particular to giving said woods characteristics of dimensional stability when they are subsequently exposed to a humid atmosphere.

The present invention thus has for its object a method for treating wood of the type in which the wood to be treated is placed in a chamber in which a vacuum is created, where said chamber is filled with a hardening product, in particular a monomer, so as to impregnate the wood by causing the product to penetrate in the space between its fibers, where said product is then hardened, in particular by polymerization, characterized in that the wood-impregnating operation is preceded by a step of controlled thermal treatment (curing).

Interestingly, said product is a monomer which is hardened by polymerization, in particular by action of a radiation or by the thermal route.

Impregnation may be effected immediately after the controlled thermal treatment step, so as to use the remaining heat of the wood in the course of cooling, in order to ensure, by the thermal route, polymerization of the monomer.

It is known that a controlled thermal treatment step consists in subjecting the wood to a thermal treatment under controlled conditions in order to provoke reactions of thermo-condensation at the level of the ligno-cellulosic structure of the wood. A controlled thermal treatment operation is usually carried out in a neutral or reducing atmosphere on previously dried wood, by subjecting the latter to a temperature included between 220° C. and 280° C. for a sufficiently long time for the whole mass of the treated wood to attain the temperature of treatment, and without exceeding this time of treatment. It will be appreciated that, under these conditions, this duration is a function of the nature and thickness of the wood.

Applicants have observed that this operation of controlled thermal treatment had three important effects, namely that of slightly increasing the porosity of the wood, of giving the latter a hydrophobic character, and of improving its wettability with respect to the monomers by modifying the surface tension of the wood. These three effects are used in particular in accordance with the present invention to promote impregnation of the wood by the monomer.

Tests made by Applicants, which will be described in detail hereinafter, have thus made it possible to demonstrate that, by effecting, according to the invention, a controlled thermal treatment operation before impregnation of the product, and particularly a monomer, not only an impregnation greater than that in accordance with the prior state of the art was obtained, but it was no longer necessary, in order to obtain such an impregnation, to pressurize the chamber containing the wood to be treated and the impregnating product.

Applicants have also established that the method according to the invention made it possible to effect an impregnation, by monomers, of varieties of wood which, up to the present time, were reputed to be virtually non-impregnable by the known methods, such as in particular spruce, oak, chestnut, beech.

According to the invention, certain of the swelling agents, such as in particular methanol, which are used according to the prior state of the art prior to the impregnation operation, are no longer necessary, which represents a saving, on the one hand, from the standpoint of cost of the product itself, and, on the other hand, from the standpoint of the cost of carrying out the method.

Polymerization of the monomer may, of course, be effected by employing a plurality of techniques and in particular among the latter by the action of gamma rays, by heating by convection and by heating by micro-waves.

BRIEF DESCRIPTION OF THE DRAWINGS

Various examples of embodiment of the invention will be described hereinafter with reference to the accompanying drawings, in which.

DETAILED DESCRIPTION OF THE INVENTION

Although Applicants have established that the present invention is applicable to numerous essences of wood, and particularly to beech, hornbeam, ash and poplar, the method according to the invention will be described by way of example in the case of application to hornbeam.

Figure 1:
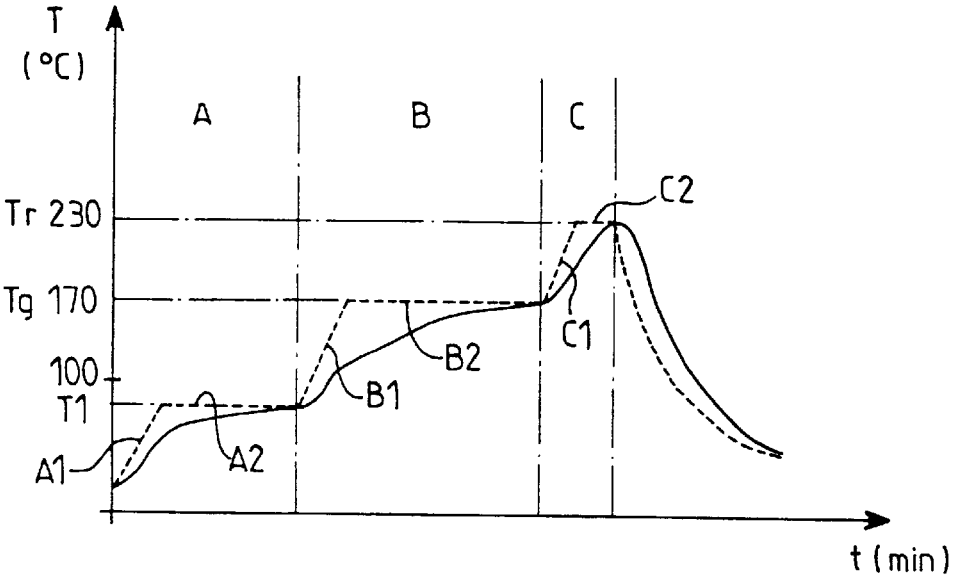
FIG. 1 is a graph which represents the variation of the temperature to which a wood to be treated is subjected as a function of time during a controlled thermal treatment operation.

It is therefore proposed to treat, according to the invention, samples constituted by pieces of hornbeam. In accordance with the invention, the first part of the treatment consists in subjecting these pieces of wood to a controlled thermal treatment. To that end, said pieces are introduced in a treatment chamber where they are subjected to programmed variations in temperature. FIG. 1 thus represents the variation of the temperature T (in °C.) as a function of time t (in mins.) to which has been taken the chamber containing the pieces of hornbeam to be treated and, in dotted lines, the temperature of the wood.

Such a process of treatment comprises three essential steps, namely a step of drying A, preferably a step of vitreous transition B, and a step C of controlled thermal treatment proper.

The first step of drying A is itself divided into two phases, a first phase A1 during which the temperature of the treatment chamber containing the hornbeam to be treated is progressively raised at a temperature elevation speed of about 5° C./min, from ambient temperature up to a temperature T1, close to 100° C., followed by a phase A2 during which the temperature of the chamber 1 is maintained at a plateau value T1 up to the end of drying.

During the second step B, which is optional but which, when it is carried out, largely improves the efficiency of the method, the temperature of the chamber is progressively raised at a temperature elevation speed close to the preceding one, from temperature T1 up to a temperature Tg close to the glass transistor temperature (vitreous transition ) of the wood in question, namely hornbeam in the present case. The temperature Tg is maintained at this plateau value for the time necessary for the whole of the mass of wood treated to attain the vitreous transition temperature Tg. It will be noted that the fact of prolonging the duration of this plateau is not translated by any detrimental consequence concerning the respect of the mechanical qualities of the product treated.

During the third step C, the temperature of the chamber is progressively raised, during a phase C1, at a speed of elevation of temperature close to the preceding one, from the vitreous transition temperature Tg to the temperature of controlled thermal treatment Tr and the temperature of the oven is maintained at this plateau value during a second phase C2 until the majority of the hemicelluloses are decomposed.

It is known that one of the difficulties of this specific step resides in the fact that the temperature must be maintained for a sufficiently long time for the hemicellulose to be decomposed virtually completely, but that it is imperative not to exceed this time, otherwise the lignin and cellulose would begin to be destroyed at the same time, which would then be translated by a fall in the mechanical characteristics of the wood treated.

This first part has made it possible to prepare the material virtually perfectly in the second part, namely the impregnation which will follow, particularly by opening the pores of the wood, by giving the latter a hydrophobic character and by increasing its wettability vis-à-vis the monomer.

This second part of the treatment is then carried out, which itself comprises two steps, namely a step of impregnation with a hardening product and in particular a polymerizable monomer, and a step of hardening, or polymerization, of the product with which the wood has been impregnated.

Figure 2:
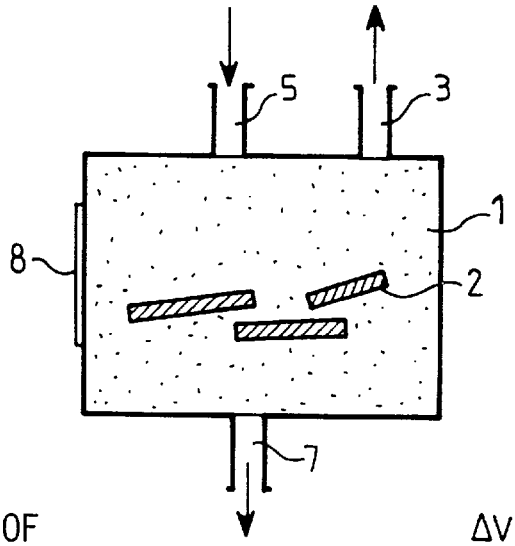
FIG. 2 schematically shows a reactor enabling an operation of impregnation of a piece of wood by a monomer to be effected.

In order to carry out the first step, a device is used, of the type shown in FIG. 2, and which is well known in the prior state of the art. This device is essentially composed of a chamber 1, or reactor, which comprises a suction conduit 3 connected to a vacuum pump (not shown in the drawing), a pipe 5 for injection of the monomer in the chamber 1, and a conduit 7 for evacuation thereof.

The wood 2 to be treated is introduced in the chamber 1 via a door 8, then a vacuum is created in the chamber by sucking the air that it contains via conduit 3 so as to empty the "cells" of the wood as much as possible. The product with which it is desired to impregnate the wood is then injected in the chamber 1. The whole is left for a duration of about thirty minutes, as a function of the viscosity of the product used, then the reactor 1 is emptied via conduit 7.

Applicants have established that the controlled thermal treatment made it possible to improve impregnation of the wood without, as in the prior state of the art, it being necessary for all that to place the product contained in the reactor 1 under pressure.

Figure 3:
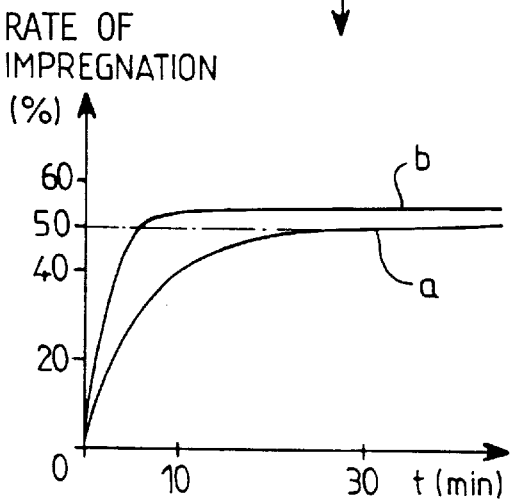
FIG. 3 is a graph which shows the variation of the rate of impregnation as a function of time, of a sample of wood by a monomer, respectively in the case of a natural wood and of a wood having undergone a controlled thermal treatment.

The curve of FIG. 3 represents the variation of the rate of impregnation of the hornbeam (in %) as a function of the time of passage t in the reactor 1, for natural hornbeam (curve a) and hombeam having previously undergone a controlled thermal treatment by a monomer which is GMA (curve b), i.e. glycidyl methacrylate. It is observed that, in both cases, the impregnation of glycidyl is stabilized after a duration of about thirty minutes and that the rate of impregnation of the hornbeam which, in the natural state, was 50%, has passed to a value of 55% when it was subjected to a controlled thermal treatment prior to impregnation. Applicants obtained results of the same order with different essences of wood and monomers, and in particular for beech, ash, poplar and various conifers.

The step of hardening of the product is then carried out. If said product is a monomer, the impregnated wood can be subjected, as a function of the nature of the monomer used, either to the action of a gamma radiation or to the action of heat in order to provoke polymerization thereof. Heating may be effected in particular by conventional convection means or by micro-waves.

Concerning polymerization by thermal means, Applicants have observed that the wood subjected to controlled thermal treatment presented a better behaviour than the natural wood. In effect, due to the treatment that it has undergone, the thermally treated wood no longer emits gas or water vapour like the natural wood, such emission being the cause of a poor adherence of the polymer.

Impregnation can also be effected immediately after the step of controlled thermal treatment so as to take advantage of the remaining heat of the wood during cooling, to ensure polymerization of the monomer by thermal means, which makes it possible both to optimalize the method and to make an energy-saving.

Applicants carried out tests in order to compare the dimensional stability of the impregnated natural wood with that of the same wood treated according to the invention, when they were disposed in a humid atmosphere.

Figure 4:
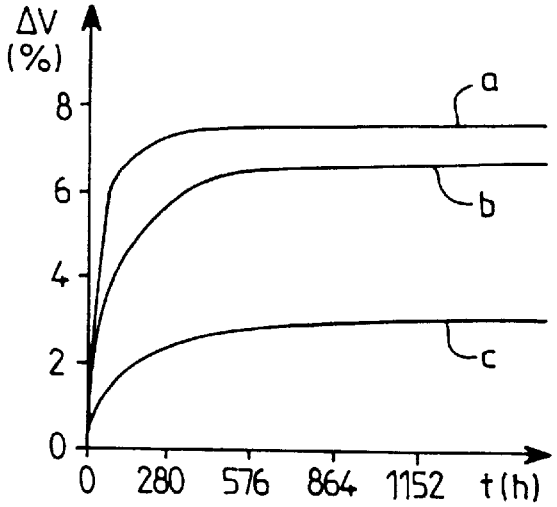
FIG. 4 is a graph which represents the variation of the swelling by volume as a function of time, of samples of wood in the presence of a humid atmosphere.

These tests were carried out in a climatic chamber in which humidity regain kinetics were effected. The chamber presented a hygrometry of 75% and a temperature of 25° C., in accordance with standard NF 51-264. The swelling was measured, as a fimction of time, of samples of wood constituted in the present case by the previously treated hombeam, respectively in the natural state (curve a), in the impregnated state according to the prior state of the art (curve b) and in the state impregnated after controlled thermal treatment (curve c). The results are noted in FIG. 4.

It is ascertained from this Figure that the impregnation has not dimensionally stabilized the wood in the natural state. In effect, there is very little difference between the natural wood (ΔV close to 7%) and the impregnated natural wood (ΔV close to 6.5%).

It is ascertained that the wood which, prior to its impregnation, underwent a controlled thermal treatment, represents a much reduced swelling ΔV since it is of the order of 3%.

Of course, Applicants furthermore treated samples of hombeam, on the one hand, in the natural state and, on the other hand, in the state after controlled thermal treatment, with the aid of monomers of various natures, namely HEMA (hydroxyethyl methacrylate), HEA (2-hydroxyethyl acrylate) and AGE-AM (mixture of 70% allyl glycidyl ether and 30% of maleic anhydride) and GMA then, after treatment, subjected these various samples to a test of swelling in accordance with standard NF 51-264 mentioned above and measured the swelling of these samples. The results have been shown in Table I hereinafter, in which they are expressed in percentage of ASE units, i.e. in percentage of the conventional coefficient of dimensional stabilization.

TABLE I

| TYPE OF WOOD | MONOMER | ASE (in % of the conventional coefficient of dimensional stabilization) |
|---|---|---|
| Natural impregnated | HEMA | 44.1 |
| " | HEA | 35.4 |
| " | AGE-AM | 42.1 |
| " | GMA | 26.6 |
| Impregnated after controlled thermal treatment | HEMA | 49.1 |

TABLE I-continued

| TYPE OF WOOD | MONOMER | ASE (in % of the conventional coefficient of dimensional stabilization) |
|---|---|---|
| Impregnated after controlled thermal treatment | HEA | 64.3 |
| Impregnated after controlled thermal treatment | AGE-AM | 59.9 |
| Impregnated after controlled thermal treatment | GMA | 77 |

It is ascertained that the different monomers used are more or less efficient as to the dimensional stabilization in humid atmosphere of the wood treated, but that, in any case, such stabilization is greater than that obtained according to the prior state of the art, i.e. by an impregnation without prior controlled thermal treatment.

In addition to the dimensional stability, the present invention also makes it possible to increase the hardness of the wood treated.

What is claimed is:

1. Method of treating wood, which consists essentially of:

placing the wood to be treated in a treatment chamber;

subjecting the wood to a controlled thermal treatment comprising the steps of a) drying said wood in an open circuit to obtain a dried wood; and b) heating and maintaining said dried wood at a controlled thermal treatment temperature ranging between 220°–300° C. for a sufficient time to obtain a heated wood; the controlled thermal treatment temperature permitting to increase the porosity of the wood, to give the wood a hydrophobic character, and to improve its wettability with respect to a hardening product by modifying the surface tension of the wood;

placing the heated wood in a reactor chamber having an internal pressure approximating atmospheric pressure;

creating a vacuum in the reactor chamber;

filling the reactor chamber with the hardening product so as to impregnate the wood by causing the product to penetrate in spaces between fibers of the wood; the controlled thermal treatment making it possible to impregnate the wood by the hardening product without overpressurizing the reactor chamber; and hardening said product at atmospheric pressure, the greater porosity and improved wettability of the heated wood avoiding the need of overpressure and of swelling agents.

2. The method according to claim 1, wherein the product is a monomer which is hardened by polymerization.

3. The method according to claim 2, wherein the monomer is selected from the group consisting of glycidyl methacrylate, hydroxyethyl methacrylate, 2-hydroxyethyl acrylate and a mixture of allyl glycidyl ether and maleic anhydride.

4. The method according to claim 1, wherein the step of drying includes a first phase of progressively raising the temperature of the treatment chamber from ambient to a first temperature, and a second phase of maintaining the temperature of the treatment chamber at said first temperature until completion of drying.

5. The method according to claim 1, wherein the controlled thermal treatment includes a step of raising the temperature of the dried wood to its glass transition temperature.

6. The method according to claim 5, wherein the step of heating and maintaining the dried wood comprises a first stage of progressively raising the temperature of the treatment chamber from the glass transition temperature to the controlled thermal treatment temperature, and a second stage of maintaining the temperature of the treatment chamber at said controlled thermal treatment temperature until a majority of hemicelluloses is decomposed.

7. The method according to claim 2, wherein the impregnation is effected immediately after the step of controlled thermal treatment.

* * * * *